US010753328B2

(12) United States Patent
Murakoshi et al.

(10) Patent No.: US 10,753,328 B2
(45) Date of Patent: Aug. 25, 2020

(54) FUEL SUPPLY DEVICES

(71) Applicant: AISAN KOGYO KABUSHIKI KAISHA, Obu-shi, Aichi-ken (JP)

(72) Inventors: Yuichi Murakoshi, Inazawa (JP); Koji Yoshida, Kasugai (JP); Tatsuki Fukui, Nagoya (JP); Shinya Higashi, Kasugai (JP); Takuya Kono, Nagoya (JP); Takayuki Kondo, Inazawa (JP); Akihiro Yano, Obu (JP)

(73) Assignee: ASIAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 367 days.

(21) Appl. No.: 15/505,150

(22) PCT Filed: Aug. 10, 2015

(86) PCT No.: PCT/JP2015/072655
§ 371 (c)(1),
(2) Date: Feb. 20, 2017

(87) PCT Pub. No.: WO2016/031541
PCT Pub. Date: Mar. 3, 2016

(65) Prior Publication Data

US 2017/0268470 A1 Sep. 21, 2017

(30) Foreign Application Priority Data

Aug. 26, 2014 (JP) ..... 2014-171441

(51) Int. Cl.
*F02M 37/10* (2006.01)
*F02M 37/00* (2006.01)
*F02M 37/08* (2006.01)

(52) U.S. Cl.
CPC ..... *F02M 37/103* (2013.01); *F02M 37/00* (2013.01); *F02M 37/10* (2013.01); *F02M 37/08* (2013.01)

(58) Field of Classification Search
CPC .... F02M 37/00; F02M 37/0076; F02M 37/08; F02M 37/10; F02M 37/103;
(Continued)

(56) References Cited

U.S. PATENT DOCUMENTS 6,230,690 B1 5/2001 Umetsu
6,716,000 B2 4/2004 Appleton et al.
6,752,129 B2 6/2004 Isozaki et al.

FOREIGN PATENT DOCUMENTS

DE 19912494 A1 9/1999
JP H11-264353 A 9/1999
(Continued)

OTHER PUBLICATIONS

Machine Translation of JP 2006142842 A PDF File Name: "JP2006142842A_Machine_Translation.pdf".*
(Continued)

*Primary Examiner* — Lindsay M Low
*Assistant Examiner* — Ruben Picon-Feliciano
(74) *Attorney, Agent, or Firm* — Conley Rose, P.C.

(57) ABSTRACT

A fuel supply device has a cover member which is attached to an opening of a fuel tank, a pump unit provided with a pump, and a connecting portion for connecting the cover member and the pump unit. The fuel supply device has a connecting shaft which is formed on either one of the connecting portion or the pump unit, and a connecting hole which is formed on the other. The fuel supply device has a guide mechanism which can guide the pump unit. The guide mechanism includes a first guide portion formed at the connecting portion and a second guide portion formed at the
(Continued)

pump unit. One of the first guide portion or the second guide portion includes a protruding portion which protrudes in a position spaced apart from the connecting shaft. The other guide portion is formed to restrict a movable range of the protruding portion.

12 Claims, 14 Drawing Sheets

(58) Field of Classification Search
CPC ..... F02M 37/106; F02M 37/20; F02M 69/04; F02M 2037/082; F02M 2037/085; F02M 2037/087
See application file for complete search history.

(56) References Cited

FOREIGN PATENT DOCUMENTS

| | | | | |
|---|---|---|---|---|
| JP | H11-264355 | A | | 9/1999 |
| JP | 2003-049729 | A | | 2/2003 |
| JP | 2003-172219 | A | | 6/2003 |
| JP | 2003-521631 | A | | 7/2003 |
| JP | 2006-009728 | A | | 1/2006 |
| JP | 2006-009729 | A | | 1/2006 |
| JP | 2006142842 | A | * | 6/2006 |
| JP | 2007-239585 | A | | 9/2007 |
| JP | 2007-270821 | A | | 10/2007 |
| JP | 2009-236061 | A | | 10/2009 |
| JP | 2012-184760 | A | | 9/2012 |
| JP | 2012184760 | A | * | 9/2012 |

OTHER PUBLICATIONS

Machine Translation of JP-2012184760-A PDF File Name: "JP2012184760A_Machine_Translation.pdf".*
Japanese Patent Application No. 2014-171441 Notification of Reasons for Refusal dated Jun. 20, 2017 (6 pages).
International Patent Application No. PCT/JP2015/072655 International Search Report dated Nov. 10, 2015 (5 pages).
German Patent Application No. 11 2015 003 195.2 Office Action dated Jan. 27, 2020 (24 pages).
Niemann, Gustav, Maschinenelemente; Band I Konstruktion und Berechnung von Verbindungen, Lagem, Wellen. Berlin, Heidelberg: Springer, Imprint: Springer 1981. S.: 364. ISBN: 978-3-662-26969-5.

* cited by examiner

FUEL SUPPLY DEVICES

CROSS-REFERENCE TO RELATED APPLICATIONS

The present application is a National Phase entry of, and claims priority to, PCT Application No. PCT/JP2015/072655, filed Aug. 10, 2015, which claims priority to Japanese Patent Application No. 2014-171441, filed Aug. 26, 2014, both of which are incorporated herein by reference in their entireties for all purposes.

STATEMENT REGARDING FEDERALLY SPONSORED RESEARCH OR DEVELOPMENT

Not applicable.

BACKGROUND

The present disclosure relates to a fuel supply device. More specifically, it relates to a fuel supply device for supplying fuel from a fuel tank mounted on a vehicle, for example in the fuel tank of an automobile, to an internal combustion engine.

Fuel supply devices used for supplying fuel to internal combustion engines and fuel supply devices attached to fuel tanks are widely known. It is also widely known that a part of these fuel supply devices can be inserted from an opening formed in an upper surface portion of the fuel tank to be attached when the fuel supply device is mounted to the fuel tank. Further, as disclosed in a Japanese Laid-Open Patent Publication No. 2012-184760 (hereinafter referred to as 760 Publication), a pump unit rotatably provided to a fuel supply device is also known.

BRIEF SUMMARY

However, the fuel supply device of the prior art, disclosed in 760 Publication, may still further be improved. The fuel supply device disclosed in 760 Publication has a connecting portion for connecting a pump unit with a cover member. The pump unit is movably connected relative to the connecting portion by using a connection shaft provided at the pump unit. According to the prior art as disclosed in 760 Publication, because the connecting shaft is merely inserted in a connecting hole, the pump unit has a limited range of motion, and cannot move smoothly relative to the connecting portion. In particular, the pump unit would not be able to move smoothly in an expected direction relative to the connecting portion if a frictional force is applied when the pump unit is moved in a torsional direction as shown with an arrow in FIG. 10. Therefore, when the pump unit moves in the torsional direction, this could cause the fuel supply device to not be securely attached to the fuel tank.

Consequently, there is a need for a configuration on the connecting portion of the fuel supply device, which would allow the pump unit to move smoothly, and enable the fuel supply device to remain securely attached to the fuel tank.

According to one aspect of the present disclosure, a fuel supply device has a cover member which is attached to an opening of a fuel tank, a pump unit provided with a pump, and a connecting portion for connecting the cover member and the pump unit. Further, the fuel supply device has a connecting shaft which is formed on either one of the connecting portion or the pump unit, and a connecting hole which is formed on the other one of these two components, where the connecting hole allows the connecting shaft to be inserted so that the pump unit is connected to the connecting portion in a relatively movable manner. Furthermore, the fuel supply device has a guide mechanism which can guide the pump unit to move along a plane orthogonal to the longitudinal axis of the connecting shaft. The guide mechanism includes a first guide portion formed at the connecting portion and a second guide portion formed at the pump unit. Either one of the first guide portion or the second guide portion includes a protruding portion which protrudes in a position spaced apart from the connecting shaft. The other guide portion is formed so as to restrict a movable range of the protruding portion.

As described above, the guide mechanism can guide the pump unit to move along the plane orthogonal to the longitudinal axis of the connecting shaft. In this way, the pump unit can move smoothly aided by the guide mechanism. The guide mechanism may have a relatively simple configuration because the guide mechanism is restricted to a limited range of motion.

According to another aspect of the present disclosure, the other guide portion has a recessed portion in which the protruding portion can be fitted to restrict the movable range of the protruding portion, due to the fitting of the protruding portion therein.

Therefore, the guide mechanism may have a relatively simple configuration because the guide mechanism is configured to have the protruding portion and the recessed portion. Such a guide mechanism may easily guide the pump unit to move along the plane orthogonal to the axis of the connecting shaft.

According to another aspect of the present disclosure, the fuel supply device has a rotation restricting mechanism. The rotation restricting mechanism may prevent the base portion, which is provided at the pump unit, from being positioned orthogonal to a plane in which a set plate portion of the cover member extends, by restricting the rotational angle of the pump unit relative to the connecting portion.

Therefore, the pump unit can easily move properly when a leading end of the base portion contacts the fuel tank. For example, the pump unit with the base portion can easily move in a proper direction, if the leading end of the base portion contacts the fuel tank in a diagonal direction.

According to another aspect of the present disclosure, the rotation restricting mechanism is configured to restrict the rotational angle of the pump unit relative to the connecting portion as the connecting portion abuts to the pump unit.

Therefore, the rotation restricting mechanism can restrict the rotational angle of the pump unit relative to the connecting portion with a relatively simple configuration. Further, the pump unit can be properly moved without increasing the number of components.

According to another aspect of the present disclosure, a fuel supply device has a cover member which is attached to an opening of a fuel tank, a pump unit provided with a pump, a connecting portion for connecting the cover member and the pump unit. Further, the fuel supply device has a connecting shaft which is formed on either one of the connecting portion or the pump unit, and a connecting hole which is formed on one of the other and allows the connecting shaft to be inserted so that the pump unit is relatively movably connected to the connecting portion. Furthermore, the fuel supply device has a rotation restricting mechanism capable of preventing the base portion, which is provided at the pump unit, from being positioned orthogonal to a set plate portion of the cover member by restricting a movable range of the pump unit relative to the connecting portion.

Therefore, the pump unit can easily move properly when a leading end of the base portion contacts the fuel tank. For example, the pump unit including the base portion can easily move in a proper direction, if the leading end of the base portion diagonally contacts the fuel tank.

DETAILED DESCRIPTION

Figure 1:
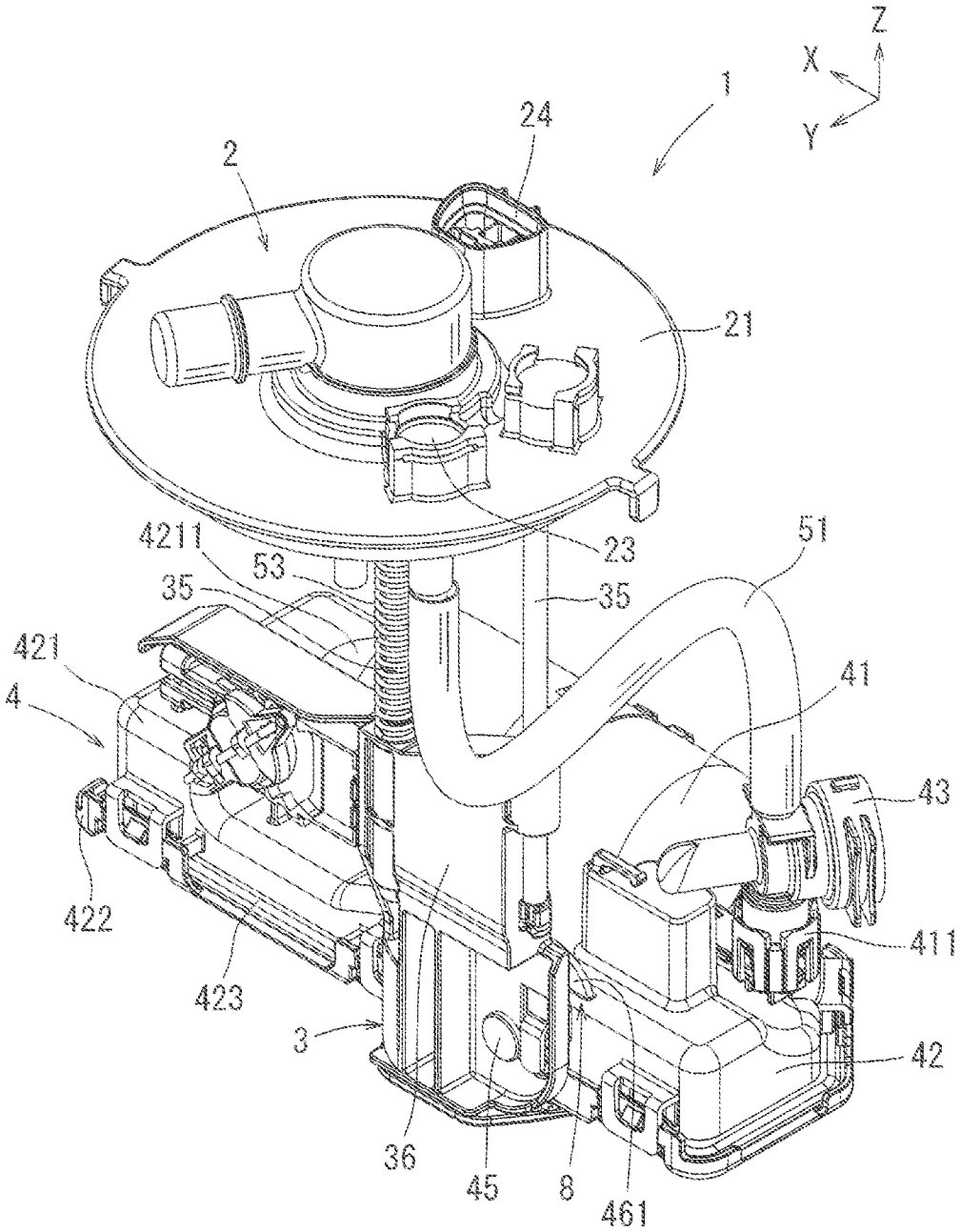
FIG. 1 is a perspective view of a fuel supply device according to one embodiment.

One embodiment of the present disclosure will now be described with reference to the drawings. Forward and backward directions, upward and downward directions as well as leftward and rightward directions in the present specification are determined such that X is a forward direction, Y is a leftward direction and Z is an upward direction as shown in FIG. 1, where the backward, rightward, and downward portions, respectively, extend in the opposite direction along the respective axis. A cover member 2 of a fuel supply device 1 is positioned at an upper side and a pump unit 4 is positioned at a lower side, below the cover member. A rotary axis of the pump unit 4 extends in the leftward and rightward directions. The forward and backward directions are orthogonal to the leftward and rightward directions, and both sets of directions are orthogonal as well to the upward and downward directions.

The fuel supply device 1 according to the present embodiment may be mounted on a vehicle, and particularly, for example, on an automobile. The fuel supply device 1 is attached to a fuel tank 7 arranged below a floor of the vehicle. The fuel supply device 1 is used to feed liquid fuel stored within the fuel tank 7 into an internal combustion engine (not shown).

The fuel supply device 1 according to the present embodiment has the cover member 2 attached to an opening 72 formed in an upper portion of the fuel tank 7. Further, the fuel supply device 1 includes a pump unit 4 having a pump 41 for delivering fuel within the fuel tank 7 to the outside, and a connecting portion 3 for connecting the pump unit 4 with the cover member 2. The pump unit 4 is installed at a bottom surface 73 of the fuel tank 7 and the cover member 2 is attached to the opening 72 of the fuel tank 7. The cover member 2 can close the opening 72 of the fuel tank 7 and through the connecting portion 3 can press the pump unit 4 along the bottom surface 73 of the fuel tank 7 (see FIG. 1 and FIG. 2).

The cover member 2 includes a set plate portion 21, which covers the opening 72 of the fuel tank 7. An outlet port 23 is provided on the substantially disk-shaped set plate 21 for leading fuel delivered from the pump unit 4 to the outside of the fuel tank 7. Further, the set plate portion 21 includes an electric connector 24 for connecting electric wiring. The opening 72 normally has a circular shape, and the set plate portion 21 has a substantially circular shape in plan view, which corresponds to the shape of the opening 72. A ring made of resin (not shown) is attached to the opening 72 to fill a clearance between the fuel tank 7 and the cover member 2 in order to reduce or eliminate the clearance.

As shown in FIG. 1, the fuel supply device 1 includes the pump unit 4 arranged below the cover member 2. The pump unit 4 includes the pump 41 used for feeding fuel and a base portion 42 used for mounting the pump 41. The base portion 42 has a substantially planar shape and is arranged so that one side surface of the base portion 42 faces the bottom surface 73 of the fuel tank 7 (see FIG. 2). The base portion 42 may also be referred to as a fuel reservoir or a sub-tank etc. The base portion 42 includes an upper base 421 to which the pump 41 is attached, a lower base 422 which contacts the bottom surface 73 of the fuel tank 7, and a filter member 423 which is placed between the upper base 421 and the lower base 422. The upper base 421 is provided with a suction port 4211 to be connected with the pump 41 and this may allow the fuel passed through the filter member 423 to be sucked by the pump 41.

The lower base 422 has an opening (bottom surface opening) (not shown) with a lattice. The lower base 422 is provided with leg portions 4222 so that the fuel can be sucked from the bottom surface opening even when the lower base 422 is arranged in abutting on the bottom surface 73 of the fuel tank 7 (see FIGS. 2 and 3). Further, an outer periphery of the upper base 421 is concentrically inward of the outer periphery of the lower base 422. A clearance is formed between the upper base 421 and the lower base 422 when the filter member 423 is not placed. The clearance can serve to introduce the fuel into the base portion 42. In this embodiment, one side surface of the upper base 421 is arranged so as to be covered by the filter member 423. As a result, the fuel entering from the clearance into the base portion 42 when the filter member 423 is not place also reaches the pump 41 through the filter member 423 when the filter member 423 is placed.

A pressure control valve 43 is attached to the pump unit 4 that is used for adjusting liquid feed pressure of the fuel. The pressure control valve 43 is attached to a valve supporting portion 411 extending from the pump 41. The fuel with adjusted pressure by the pressure control valve 43 is fed to the internal combustion engine, for example, through a hose 51 and the outlet port 23.

The connecting shaft 45 provided at the pump unit 4 is inserted in the connecting hole 31 formed in the connecting portion 3 to connect the pump unit 4 with the connecting portion 3. Consequently, the connecting portion 3 and the pump unit 4 are connected about the connecting shaft 45 so as to be movable relative to each other (see arrow in FIG. 4). The fuel supply device 1 has a guide mechanism 8, which can guide the pump unit 4 to move along a plane orthogonal to the longitudinal axis of the connecting shaft 45 (see FIG. 5). The guide mechanism 8 includes a first guide portion 331 formed in the connecting portion 3 and a second guide portion 461 formed on the pump unit 4. According to one example as shown in FIG. 5, the first guide portion 331 is provided as a recessed portion and the second guide portion 461 as a protruding portion (see FIG. 7).

Figure 6:
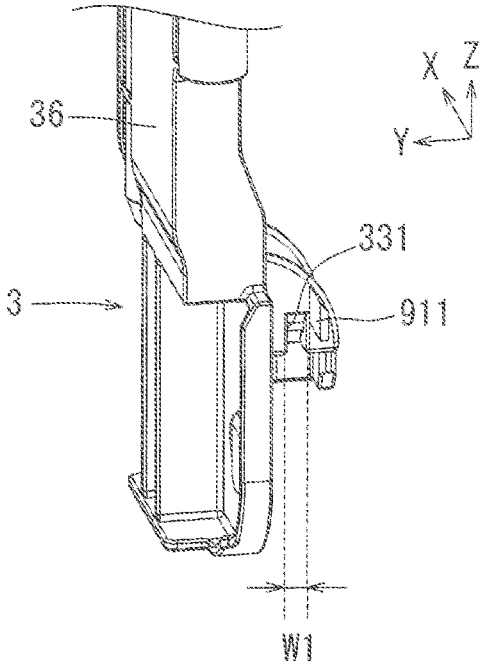
FIG. 6 is an enlarged perspective view of a connecting portion of FIG. 1 near a first guide portion.

The first guide portion 331, which may be a recessed portion, can guide the pump unit 4 to move along a plane orthogonal to the longitudinal axis of the connecting shaft 45 while the protruding portion restricts the movable range of the protruding portion. The recessed portion of the first guide portion 331 is formed as a groove which extends in a downward direction substantially orthogonal to a penetration direction of the connecting hole 31 along the leftward-rightward axis (see FIGS. 6 and 8). The recessed portion of the first guide portion 331 as shown in FIG. 6 has an inner peripheral surface, forming the bottom side of the groove shown by the dashed line in FIG. 8, which expands upwardly and outwardly from an opening portion. The opening portion is elongated in the forward and backward directions and configured to have a substantially rectangular shape. The inner peripheral surface expands from both front and rear ends of the opening portion and has a shape corresponding to an outer peripheral surface of the second guide portion 461, for example, a circular-arc shape. The first guide portion 331 includes left and right walls adjacent to the inner peripheral surface, which oppose the left and right surfaces of the second guide portion 461 when it is inserted in the recessed portion of the first guide portion 331. As described above, the first guide portion 331 has the recessed portion, i.e., the groove, and a width W1 of this groove in a lateral direction is slightly larger than a thickness W2 in a lateral direction of the protruding portion which is provided as the second guide portion 461 so that sliding resistance is hardly generated between the protruding portion and the recessed portion when the former is inserted in the latter (see FIGS. 6 and 7).

Figure 7:
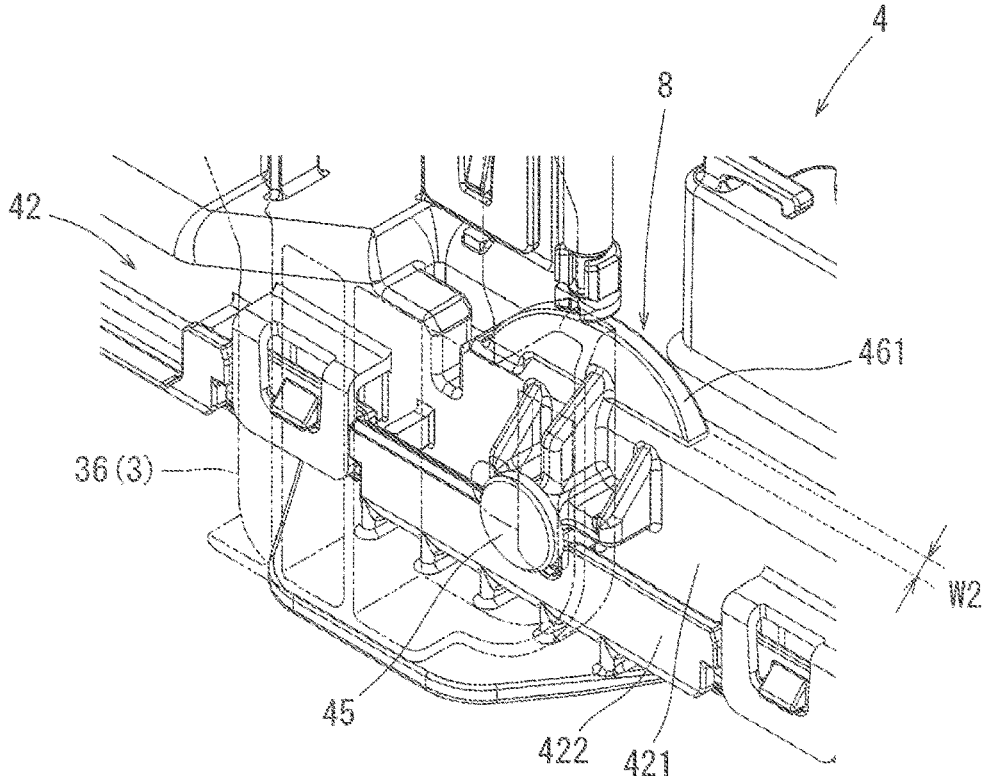
FIG. 7 is an enlarged perspective view of the pump unit of FIG. 1 near a second guide portion.

The outer periphery of the protruding portion of the second guide portion 461 has a circular-arc shape from a side view as seen from an axial direction of the longitudinal axis of the connecting shaft 45 (see FIG. 7). The recessed portion of the first guide portion 331 has the inner periphery in a circular-arc shape to correspond to the protruding portion. Therefore, because of the complementarity of fit, even when the protruding portion abuts the bottom surface of the recessed portion, the pump unit 4 can easily move in a smooth manner.

Figure 4:
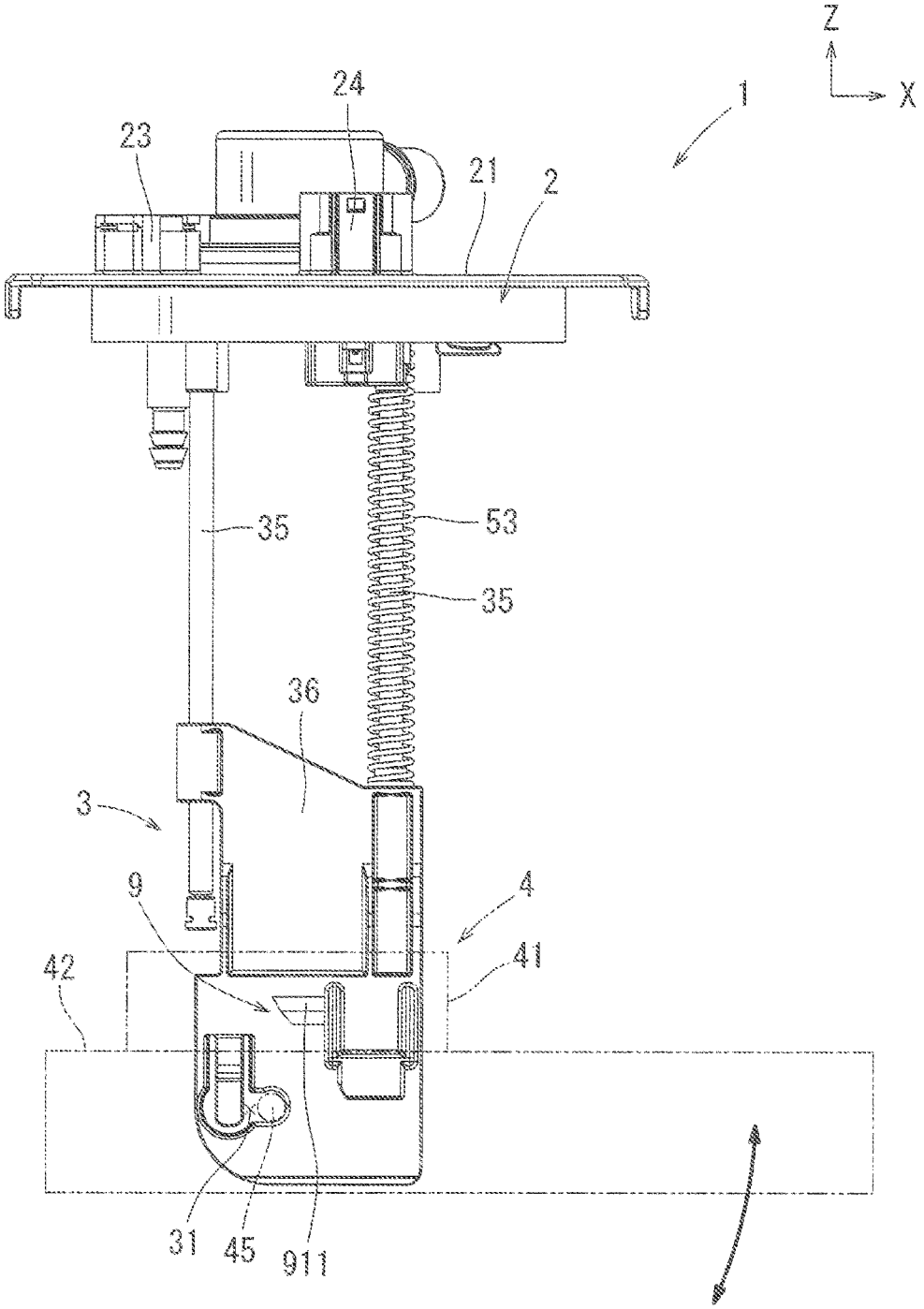
FIG. 4 is a schematic right side view of the pump unit of the fuel supply device of FIG. 1.
Figure 5:
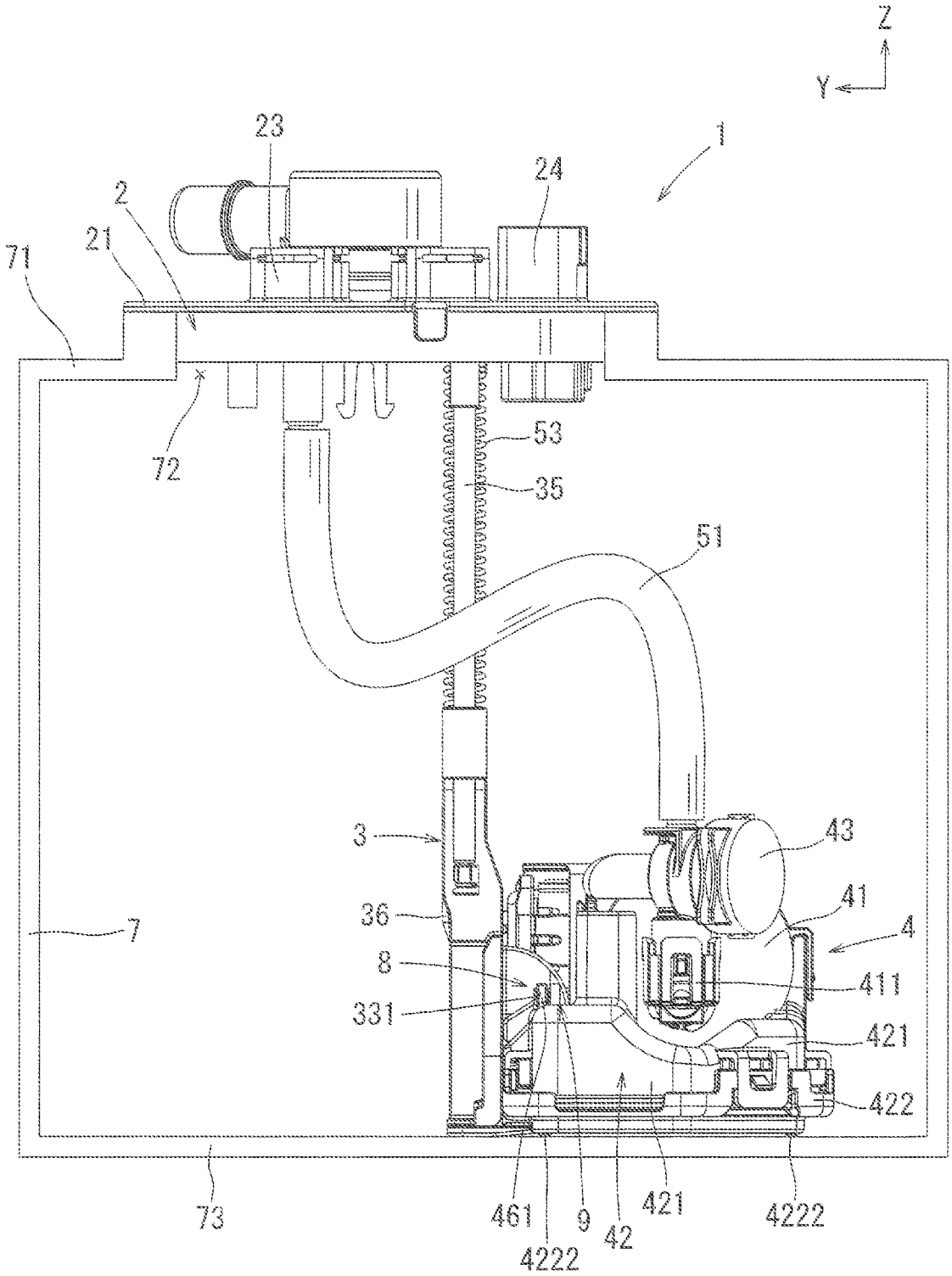
FIG. 5 is a rear view of the fuel supply device of FIG. 1 that is mounted to the fuel tank.
Figure 9:
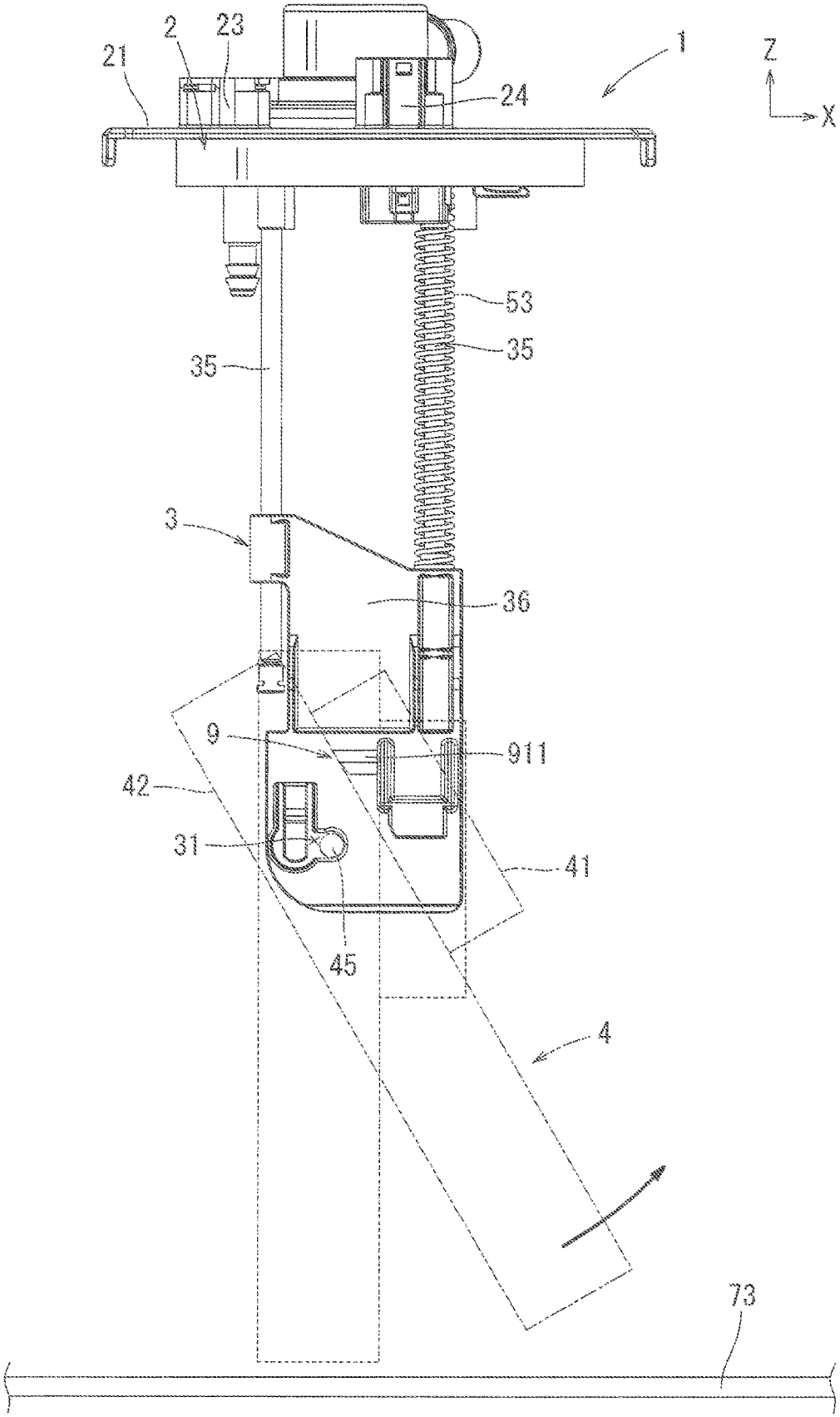
FIG. 9 is a schematic side view with dashed double dotted lines that illustrates a situation in which one end of the pump unit is positioned farthest from a cover member when the fuel supply device is lifted while the cover member of the fuel supply device of FIG. 1 is held.

The fuel supply device 1 has a rotation restricting mechanism 9, which serves to restrict a movable range of the pump unit 4 as shown in FIGS. 4 and 9. Particularly, the rotation restricting mechanism 9 restricts such that a plane in which the base portion 42 extends (upper surface of the base portion 42 in FIG. 4) is not orthogonal (position as shown in broken line in FIG. 9) to a plane in which the set plate portion 21 on the cover member 2 extends (plane extending in longitudinal and lateral directions). Therefore, the pump unit 4 will never be in a position as shown in broken line in FIG. 9, where it would be orthogonal to set plate portion 21. In other words, the rotation restricting mechanism 9 restricts rotational movement of the pump unit 4 such that a longitudinal direction of the pump unit 4 does not intersect orthogonal to the cover member 2. Alternatively stated, the rotation restricting mechanism 9 restricts rotational movement of the pump unit 4 such that the longitudinal direction of the pump unit 4 does not extend parallel to the longitudinal direction of the connecting portion 3.

Figure 8:
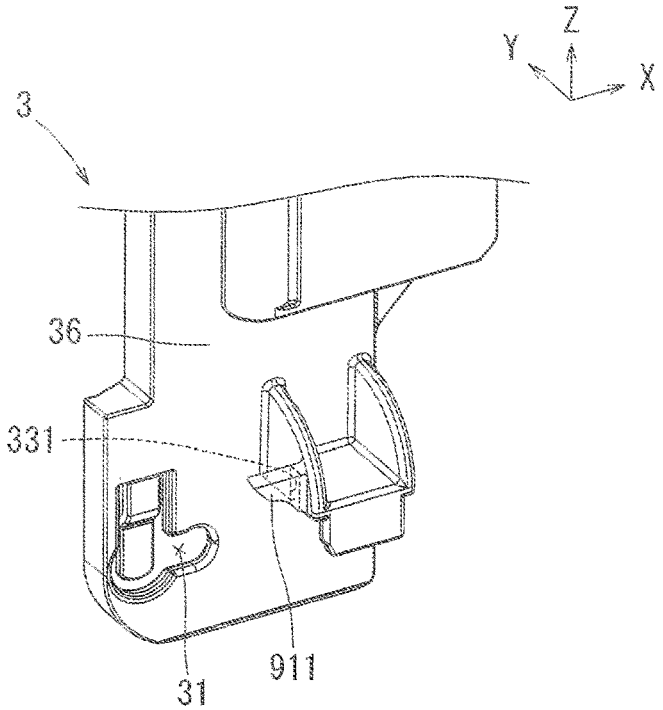
FIG. 8 is an enlarged side view of the connecting portion of FIG. 1 near the first guide portion.
Figure 10:
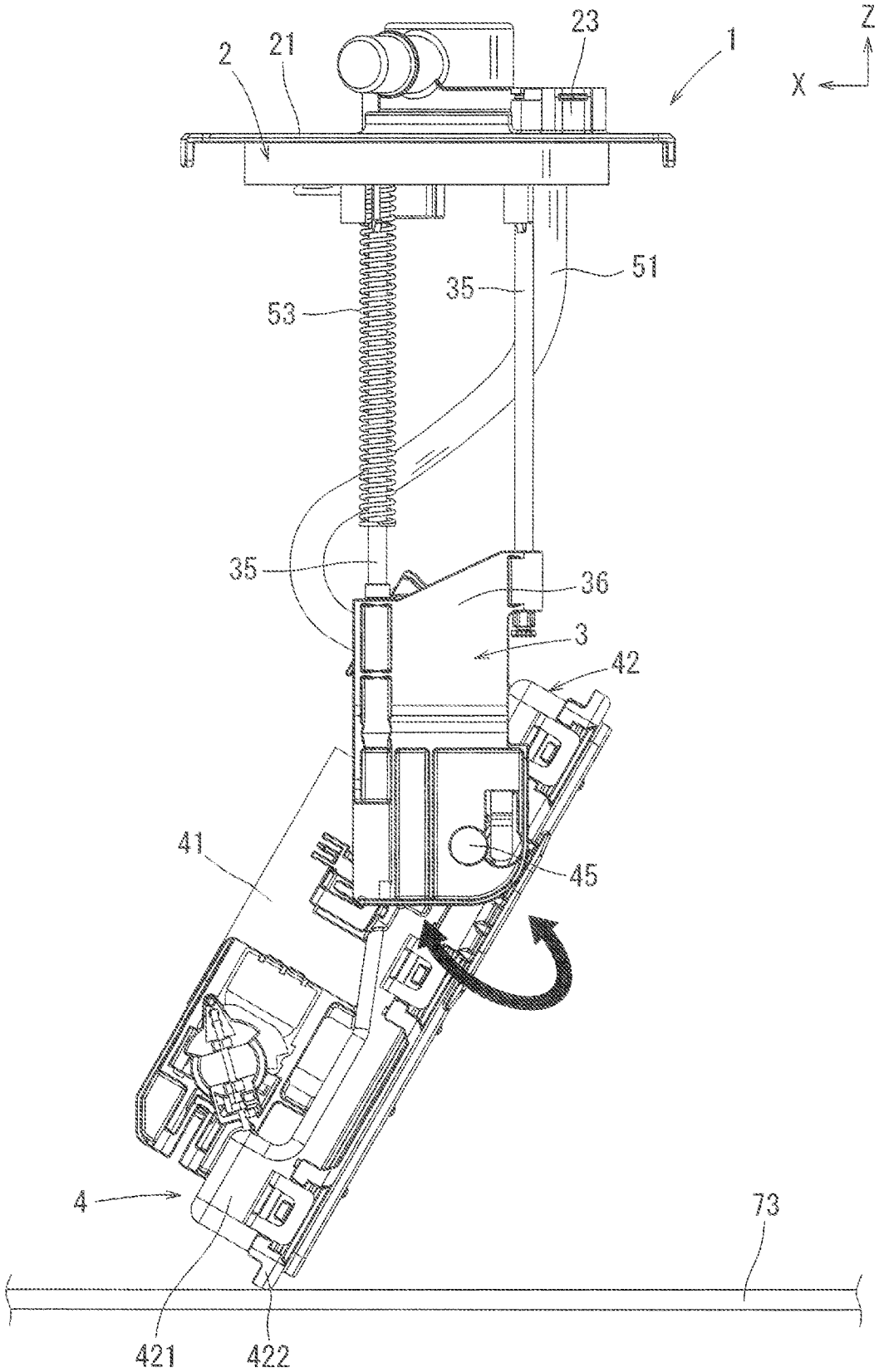
FIG. 10 is a side view in the situation in that one end of the pump unit is positioned at the farthest position from the cover member when the fuel supply device is lifted while the cover member of the fuel supply device of FIG. 1 is held.

The rotation restricting mechanism 9 has a stopper portion 911 formed on the connecting portion 3 as shown in FIG. 8. The stopper portion 911 is configured as a projection so that it can abut the upper surface of the pump unit 4. As shown in FIGS. 9 and 10, the stopper portion 911 abuts on the pump unit 4 when the pump unit 4 reaches in a predetermined position in a case the fuel supply device 1 is lifted while the cover member 2 is held. As a result, the stopper portion 911 restricts the movable range of the pump unit 4 and the pump unit 4 is maintained in an inclined state, not orthogonal to the set plate portion 21.

As shown in FIG. 10, while the pump unit 4 is in the inclined state, the leading end of the pump unit 4 contacts the bottom surface 73 of the fuel tank 7. At this time, the plane, in which the set plate portion 21 extends, is parallel to, for example, the bottom surface 73. In contrast, the plane, in which the base portion 42 extends, is inclined with respect to the bottom surface 73 of the fuel tank 7, at an angle relative to the horizontal (bottom surface 73). The pump unit 4 rotates about the connecting shaft 45 while being guided towards the bottom surface 73. The trailing end of the pump unit 4 in the inclined state is arranged in a position displaced from the connecting shaft 45 in a horizontal direction. Consequently, in this configuration, the pump unit 4 can rotate easily about the connecting shaft 45. FIG. 10 serves as an example, wherein pump unit 4 is maintained at an incline of about 60 degrees with respect to the horizontal (bottom surface 73 and set plate portion 21). However, this angle may vary, and can be any angle as long as it does not extend beyond the scope of the disclosure (e.g. the pump unit cannot be at an incline of 90 degrees from the horizontal, because then it would be orthogonal to set plate portion 21).

As shown in FIG. 9, the longitudinal axis of the connecting shaft 45 and the penetration direction of the connecting hole 31 (out of the page in the rightward direction) extend substantially in parallel, when the rotational movement of the pump unit 4 is restricted by the stopper portion 911. Therefore, the pump unit 4 can easily move relative to the connecting portion 3 when the fuel supply device 1 is lowered so that one end of the pump unit 4 contacts the fuel tank 7.

Figure 2:
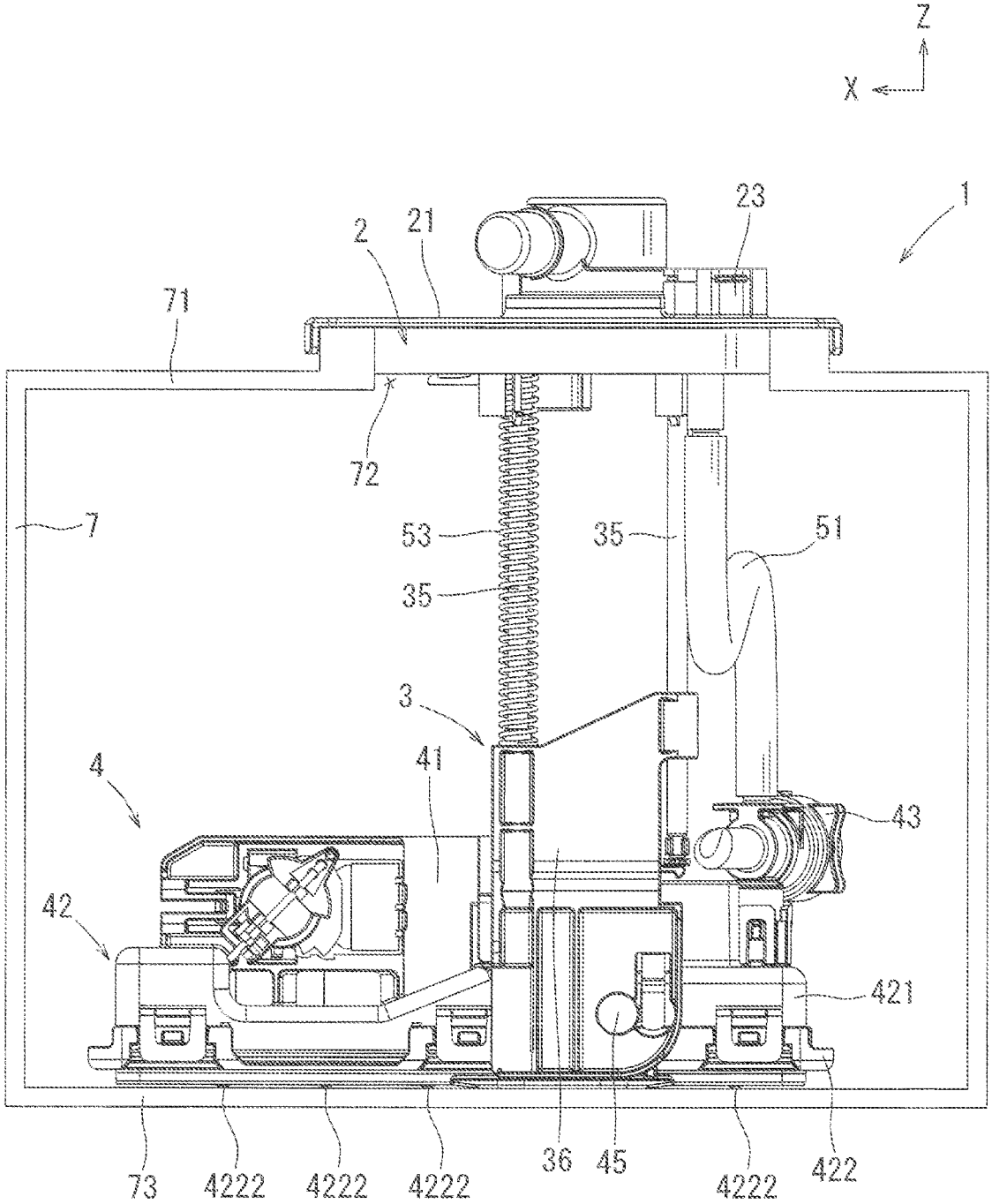
FIG. 2 is a left side view of the fuel supply device of FIG. 1 that is mounted to a fuel tank.
Figure 3:
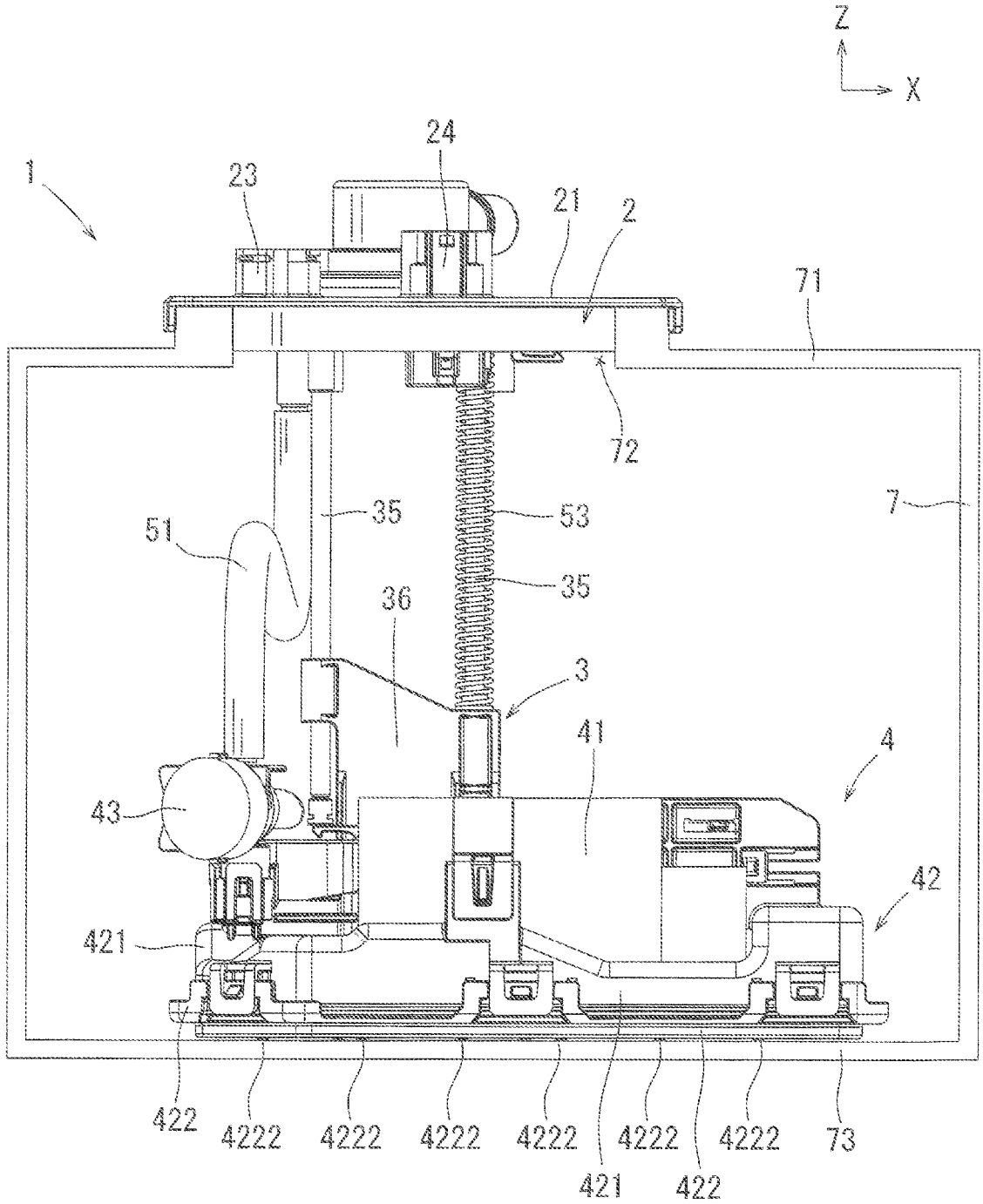
FIG. 3 is a right side view of the fuel supply device of FIG. 1 that is mounted to the fuel tank.

A method for attaching the fuel supply device 1 as shown in FIG. 2 to the fuel tank 7 will now be described as follows. The opening 72 is usually provided in one part of the upper surface portion 71 of the fuel tank 7, which is formed to be parallel to the bottom surface 73. The pump unit 4 of the fuel supply device 1 is inserted into the fuel tank 7 from the opening 72 where through its weight it causes the set plate portion 21 on the cover member 2 to be pressed against the opening 72. Consequently, the pump unit 4 is pressed against the bottom surface 73 of the fuel tank 7. The cover member 2 is then attached to the opening 72.

As shown in FIG. 2, the pump unit 4 has the connecting shaft 45 in a position displaced from the center of gravity of the pump unit 4. Therefore due to the imbalance, when the fuel supply device 1 is lifted, one end of the pump unit 4, the leading end, automatically moves below the connecting shaft 45 (see FIGS. 4 and 10). In contrast, the other end of the pump unit 4 will move automatically above the connecting shaft 45. In other words, one end of the pump unit 4 automatically moves downward when the fuel supply device 1 is lifted while the cover member 2 is held, in order to attach the fuel supply device 1 to the fuel tank 7.

When the fuel supply device 1 is inserted from the opening 72, one end of the pump unit 4 enters first from the opening 72. The pump unit 4 is inserted into the fuel tank 7 in an upright state relative to the bottom surface 73. The cover portion 2 is arranged so as to be in parallel to the upper surface portion 71 of the fuel tank 7 when the pump unit 4 is received within the fuel tank 7. At this time, when said pump unit 4 is received in the tank, the pump unit 4 rotates together with the cover member 2 so as to be moved from the upright state to an inclined state relative to the bottom surface 73 of the fuel tank 7 since the rotation restriction mechanism 9 is in action. When the cover member 2 of the fuel supply device 1 is then moved towards the opening 72, the inclined pump unit 4 contacts the fuel tank 7 and is pushed further downwardly. As a result, the bottom surface of the pump unit 4 moves so as to face the bottom surface 73 of the fuel tank 7. At this time, the plane, in which the base portion 42 extends, is inclined relative to the bottom surface 73 of the fuel tank 7 so that a position of one end of the pump unit 4 is displaced from a position, in which the connecting shaft 45 is arranged, in plan view. Therefore, it is only necessary to push the fuel supply device 1 toward the bottom surface 73 to rotate the pump unit 4 about the connecting shaft 45.

Further, the guide mechanism 8 determines the movement in a travel direction after one end of the pump unit 4 contacts the fuel tank 7. As a result, when one end contacts the fuel tank 7, through the action of the guide mechanism 8 and first and second guide portions 331, 461, the backlash during the movement is prevented from being generated, so that the pump 41 can be smoothly moved through the complementary fit of the protruding guide portion 461 into the recessed guide portion 331, as explained previously. In particular, through said fit, rotation of the pump unit 4 in leftward and rightward directions relative to the connecting portion 3 may be restricted, so that the pump unit 4 can smoothly rotate in a plane orthogonal to the longitudinal axis of connecting shaft 45, about the connecting shaft 45.

The connecting portion 3 of the fuel supply device 1 in FIG. 2 can be extended and retracted. The connecting portion 3 includes a rod member 35 attached to the cover member 2 and a joint portion 36 which is movable along the rod member 35. The rod member 35 extends in a direction orthogonal to a plane in which the set plate portion 21 extends. Further, a spring member 53 is arranged between the joint portion 36 and the cover member 2 that can exert elastic force. The spring member 53 serves to bias the cover member 2 to move apart from the pump unit 4 when the cover member 2 and the pump unit 4 approach closer than a predetermined distance. Therefore, the spring member 53 will be compressed when the cover member 2 approaches the bottom surface 73 of the fuel tank 7 at a distance closer than the distance threshold. In such a state where the bottom surface of the pump unit 4 contacts the bottom surface 73 of the fuel tank 7, as long as this compressed state of the spring member 53 is maintained, the pressed state of the pump unit 4 against the bottom surface 73 will also be maintained.

While the embodiments of disclosure have been described with reference to specific configurations, it will be apparent to those skilled in the art that many alternatives, modifications and variations may be made without departing from the scope of the present disclosure. Accordingly, embodiments of the present disclosure are intended to embrace all such alternatives, modifications and variations that may fall within the spirit and scope of the appended claims. Embodiments of the present disclosure should not be limited to the representative configurations, but may be modified, for example, as described below.

Figure 11:
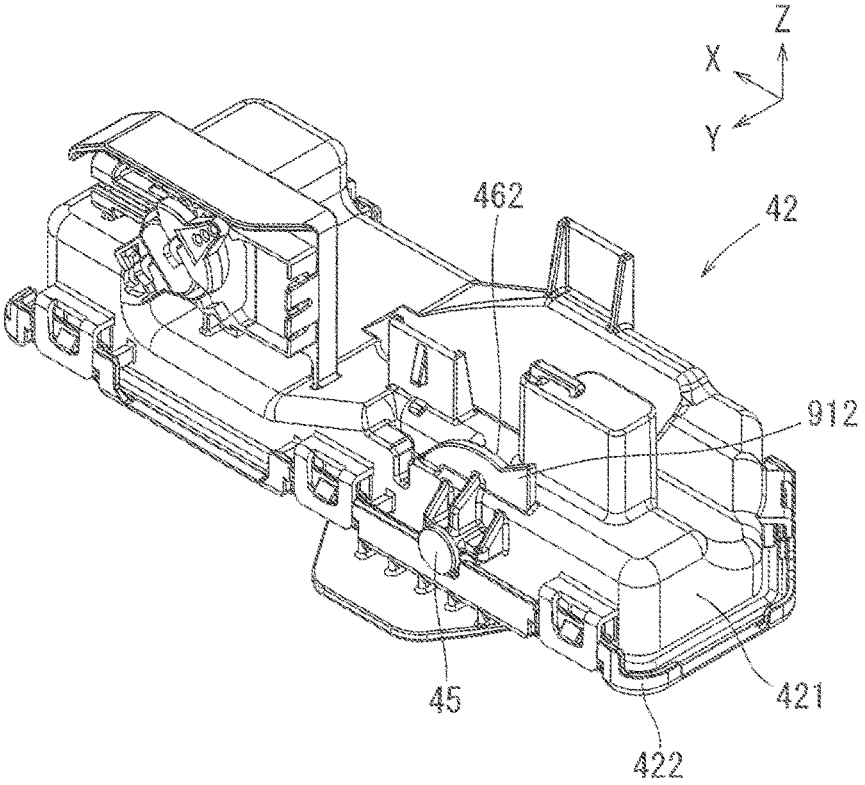
FIG. 11 is a perspective view of a base portion used in a fuel supply device according to another embodiment.

For example, one embodiment having a configuration as shown in FIG. 11 will be briefly described. The fuel supply device 1 according to this embodiment is different from the above embodiment in that it includes the configuration of a second guide portion 462 configuring an element of the guide mechanism 8 and a stopper portion 912 configuring the rotation restricting mechanism 9. The remaining configurations are substantially identical to those of the above embodiment, therefore, only the differences will be mainly described as follows.

The fuel supply device 1 having a configuration as shown in FIG. 11 includes a stopper portion 912 shown in FIG. 11 instead of the stopper portion 911 shown in FIG. 8. The stopper portion 912 is not provided at the connecting portion 3 shown in FIG. 8, but at the pump unit 4 as shown in FIG. 11. More particularly, as shown in FIG. 11, the stopper portion 912 is provided on the upper base 421 of the base portion 42. In this embodiment, the second guide portion 462 and the stopper portion 912 are continuously formed without being apart from each other. More particularly, a plate-like projection formed on the upper base 421 has an arc-shaped portion in side view and a portion formed to project from the arc-shaped portion in a radial direction. Because of this configuration, the stopper portion 912 and the protruding portion configuring the second guide portion 462 are continuously formed on the projection.

A part of the connecting member 3 according to this embodiment can move along the arc-shaped portion, which is formed as the second guide portion 462 as shown in FIG. 11, however, the movement will be restricted when the part of the connecting portion 3 abuts the stopper portion 912 which protrudes radially from the arc-shaped protruding portion. In this manner, through the interaction of the connecting member 3 and the stopper 912, the pump unit 4 is prevented from rotating any further than the point where the connecting portion 3 abuts the stopper portion 912.

Figure 12:
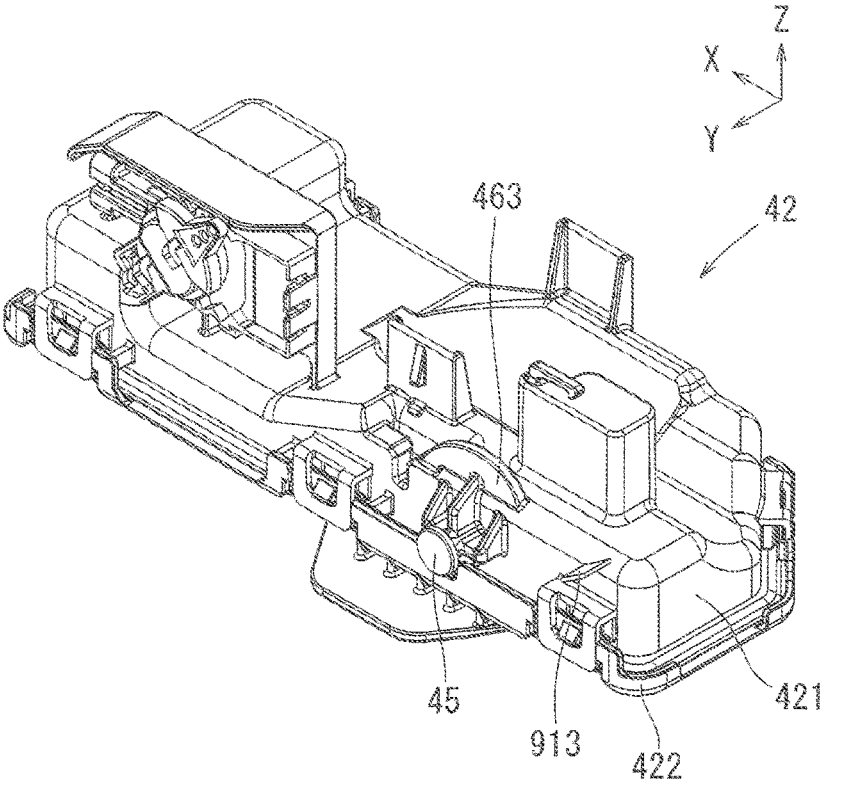
FIG. 12 is a perspective view of a base portion used in a fuel supply device according to another embodiment.
Figure 13:
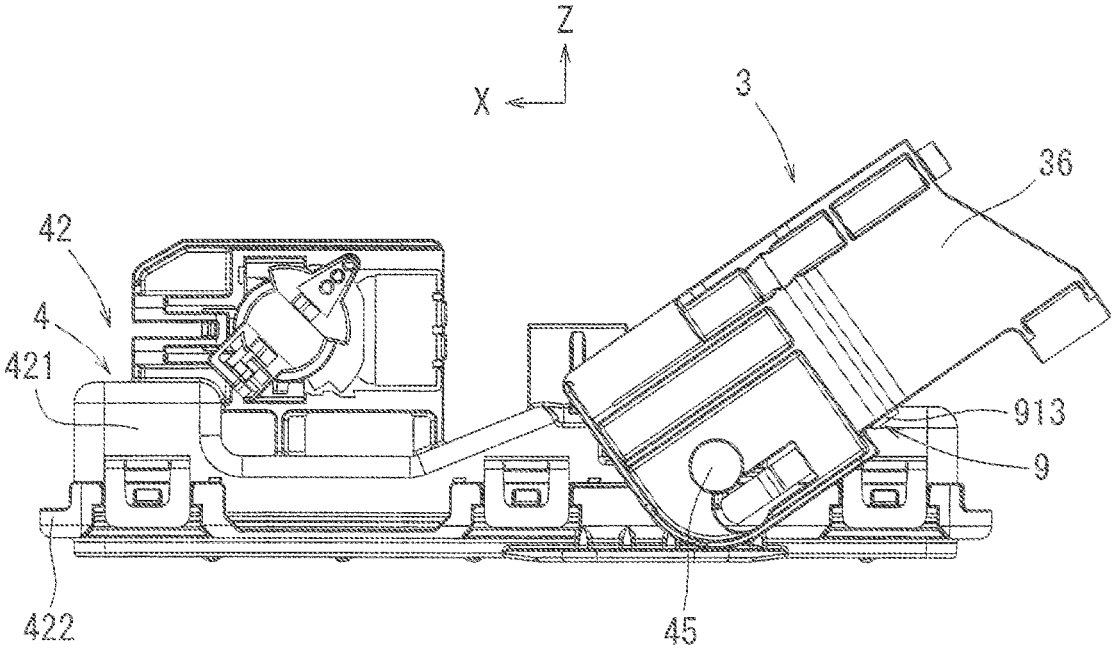
FIG. 13 is a side view illustrating a situation where a stopper portion provided at the base portion of FIG. 12 abuts a connecting portion.

Hereinafter, the other embodiment having a configuration as shown in FIGS. 12 and 13 will be briefly described. The fuel supply device 1 according to this embodiment, is different from the above embodiment in that it has the stopper portion 913 configuring the rotation restriction mechanism 9. The remaining configurations are substantially identical to those of the above embodiment, therefore, only the differences will be mainly described as follows.

As shown in FIG. 12, the stopper portion 913 for restricting a movable range of the pump unit 4 may be provided to the pump unit 4 similarly to the stopper portion 912 in FIG. 11. However, unlike the stopper portion 912 in FIG. 11, the stopper portion 913 in FIG. 12 is positioned separately, apart from the second guide portion 463 provided on the upper base 421. More specifically, the stopper portion 913 is provided to protrude from a lateral side of the upper base 421, at an angle relative to the longitudinal axis of the upper base. As described above, the stopper portion 913 is formed as a planar projection and is configured such that one surface of the stopper portion 913 can abut the connecting portion 3 (see FIG. 13). Because this stopper portion 913 is configured to protrude from the upper base 421 in a lateral direction, the corresponding lateral surface of the connecting portion 3 can be supported in a stable manner. Further, because in this manner the connecting portion 3 can be supported at a distance relatively more distal in the upward direction from the connecting shaft 45, this provides additional fortification and stability for the connecting portion 3.

Hereinafter, the other embodiment having a configuration shown in FIGS. 14 and 15 will be briefly described. The fuel supply device 1 according to this embodiment, is different from the above embodiment in that it has the stopper portion 914 configuring the rotation restriction mechanism 9. The remaining configurations are substantially identical to those of the above embodiment, therefore, only the differences will be mainly described as follows.

Figure 14:
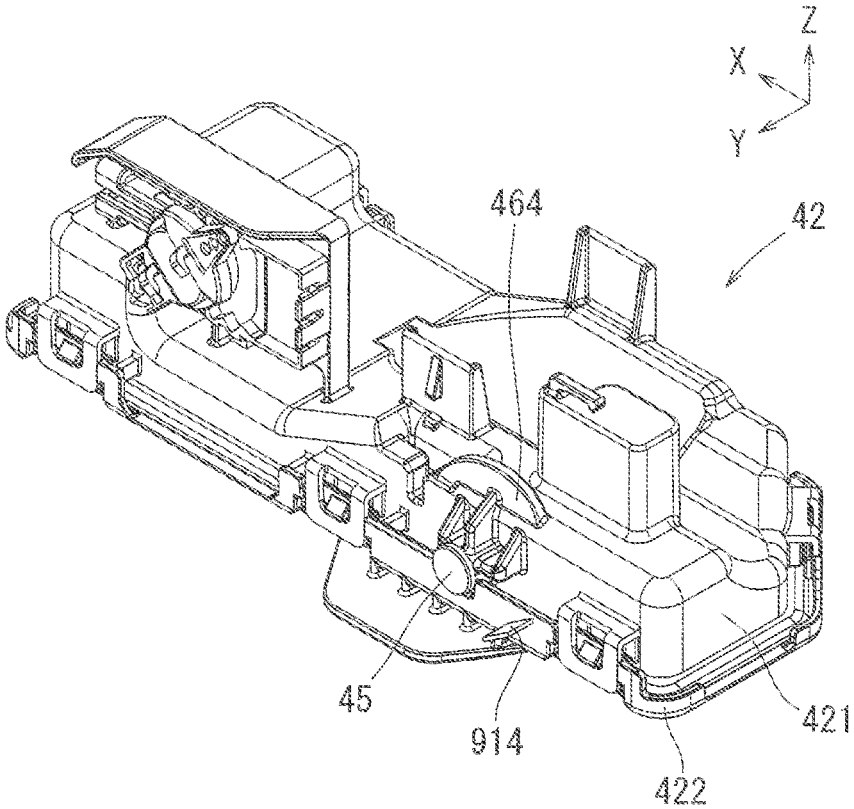
FIG. 14 is a perspective view of the base portion used in a fuel supply device according to another embodiment.
Figure 15:
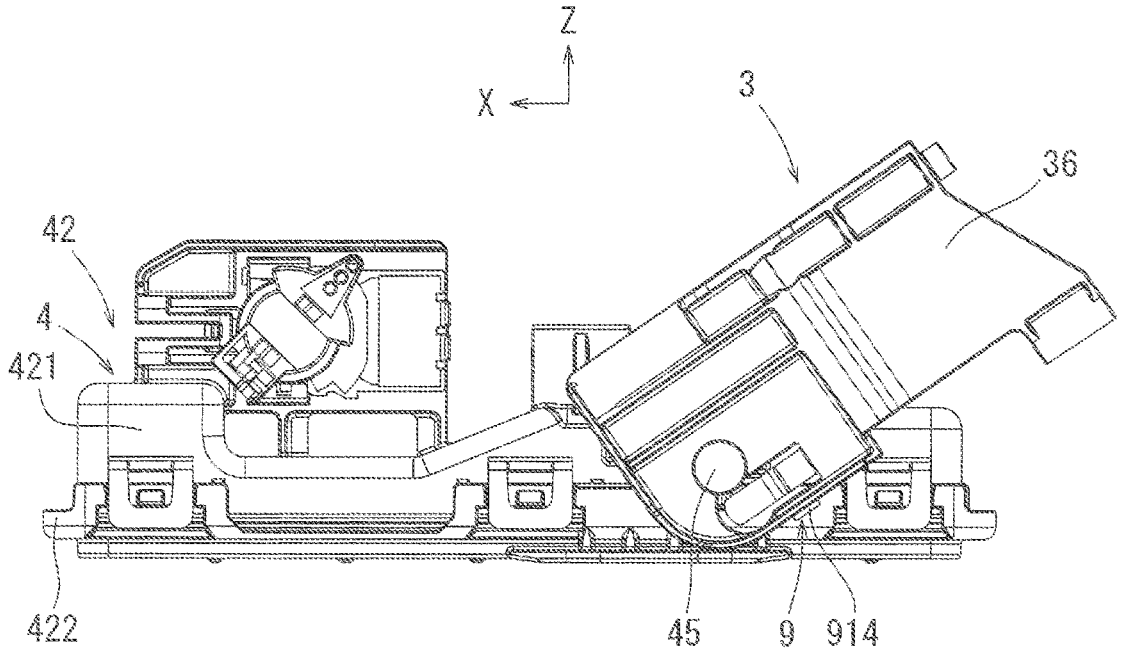
FIG. 15 is a side view illustrating a situation where a stopper portion provided at the base portion of FIG. 14 abuts a connecting portion.

The second guide portion 464 as shown in FIGS. 14 and 15 is, similar to the second guide portion 462 in FIG. 11 and the second guide portion 463 in FIG. 12, provided on the upper base. The stopper portion 914 shown in FIGS. 14 and 15 is, similar to the stopper portion 912 in FIG. 11 and the stopper portion 913, provided at the pump unit 4 for restricting the movable range of the pump unit 4. However, unlike the stopper of the previous embodiments, the stopper portion 914 is provided on the lower base 422 instead of the upper base 421 of the pump unit 4. The stopper portion 914 is provided to protrude from a lateral surface of a lower base 422 as shown in FIG. 14. As shown in FIG. 15, because the stopper portion 914 is configured to protrude from the lower base 422 in a lateral direction at an angle relative the plane of the base portion 42, the lateral surface of the connecting portion 3 can thereby be supported in a stable manner.

Hereinafter, the other embodiment having a configuration shown in FIGS. 16 and 17 will be briefly described. The fuel supply device 1 according to this embodiment, is different from the above embodiment in that it has the first guide portion 335 and the second guide portion 465 configuring the rotation restriction mechanism 9. The remaining configurations are substantially identical to those of the above embodiment, therefore, only the differences will be mainly described as follows.

Figure 16:
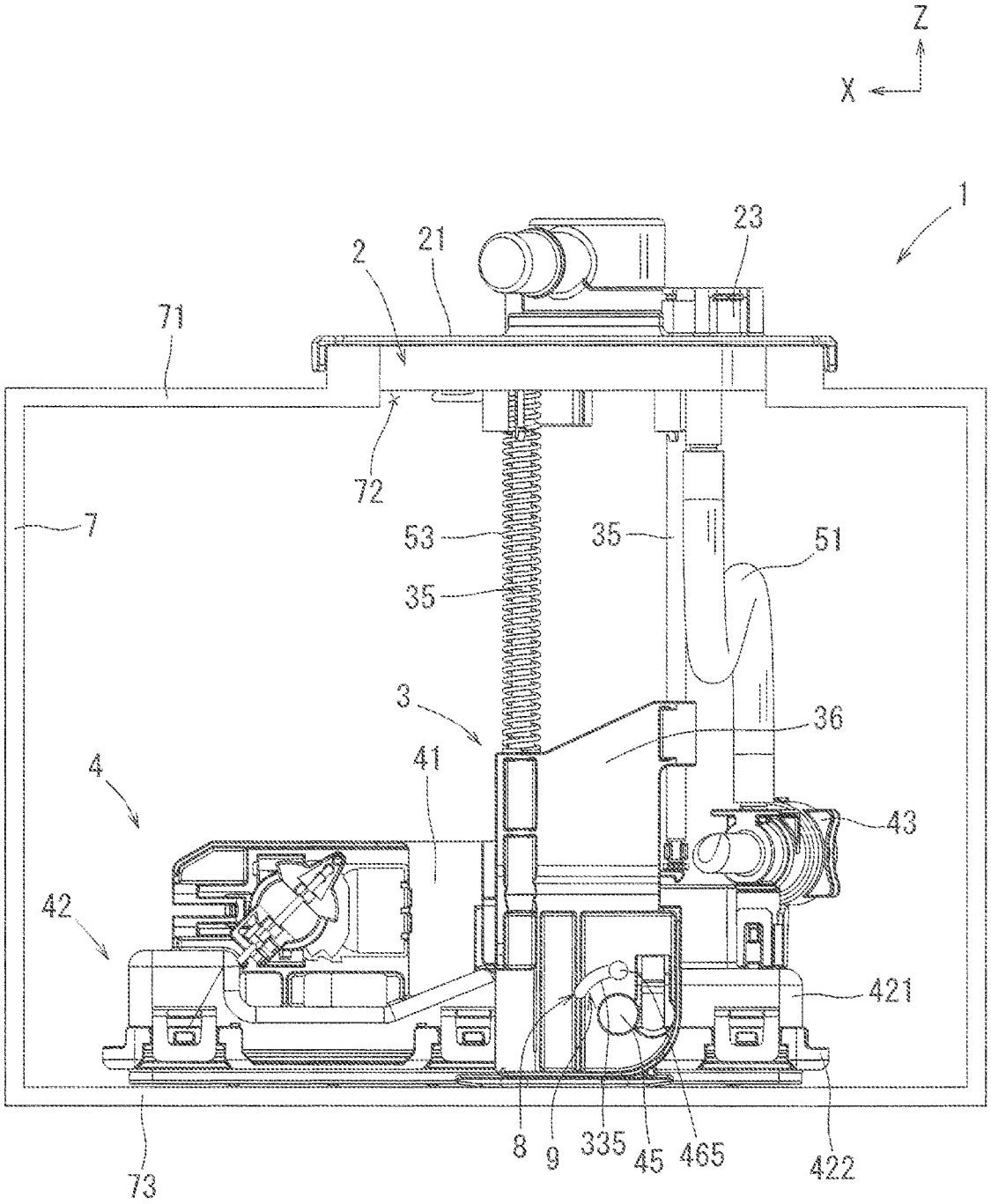
FIG. 16 is a left side view of the fuel supply device according to another embodiment, that is mounted to the fuel tank.
Figure 17:
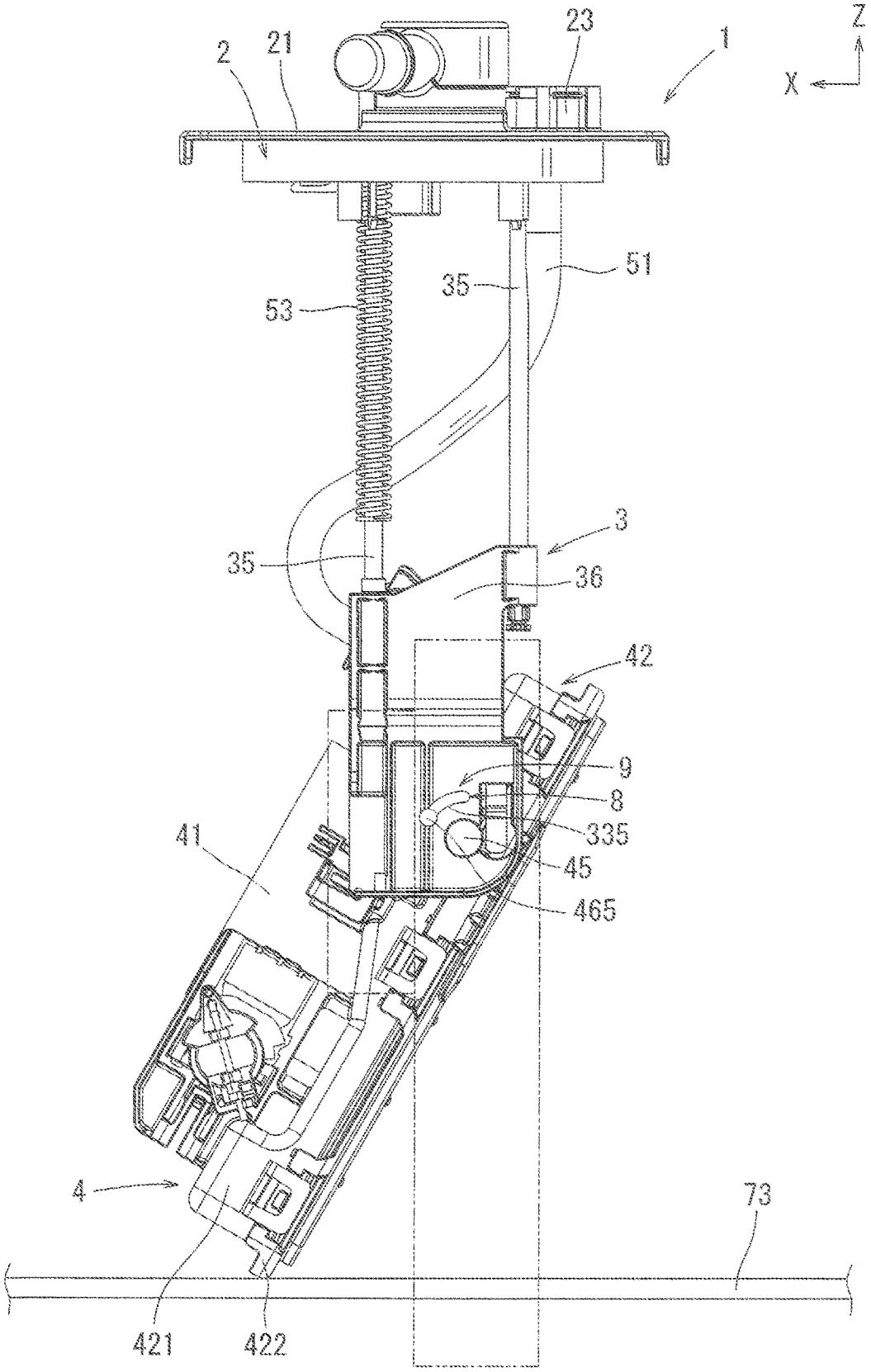
FIG. 17 is a side view illustrating a situation where the fuel supply device of FIG. 16 is lifted.

As shown in FIGS. 16 and 17, the first guide portion 335 is configured to have a hole portion unlike the first guide portion 331 shown in FIG. 6 having a recessed portion. The second guide portion 465 is a protruding portion which is inserted in the hole portion. The second guide portion 465 is provided on a lateral surface of the pump unit 4 and protrudes, for example, from the upper base 421 in a leftward direction toward joint portion 36. The second guide portion 465 is, for example, a columnar pin and inserted in the first guide portion 335. The first guide portion 335 is a through hole penetrating through the joint portion 36 along the leftward-rightward axis and extending in a circular arc around the connecting shaft 45 as a center. Therefore, the movement of the second guide portion 465 is guided by the first guide portion 335. Accordingly, the first guide portion 335 and the second guide portion 465 configure the guide mechanism 8 which guides the rotational movement of the pump unit 4.

Further, as shown in FIGS. 16 and 17, the second guide portion 465 moves along the first guide portion 335 and can only move within the range of the first guide portion 335. As a result, the movement of the second guide portion 465 is restricted at the edge of the first guide portion 335. As shown by a solid line in FIG. 17, the first guide portion 335 is configured so that the plane, in which the base portion 42 extends, does not intersect orthogonal to the plane, in which the set plate portion 21 on the cover member 2 extends. In this case, the through hole (first guide portion 335) and the protruding portion (second guide portion 465) configure both the guide mechanism 8 as well as the rotation restriction mechanism 9.

According to the embodiment shown in FIGS. 16 and 17, the pump unit 4 cannot be arranged in a position as shown by dashed double dotted lines in FIG. 17 because the rotation restricting mechanism 9 is provided. Alternatively, the first guide portion 335 may be configured, for example to have a longer circular arc than that of in FIG. 17, so that the pump unit 4 can be arranged in the position shown by dashed double dotted lines in FIG. 17.

Instead of the above embodiment, a canister portion filled with an adsorbent may be provided to the cover member. In this case, a connecting portion may be configured to connect the canister portion and the pump unit. Further, although the cover member is provided with the canister portion, the connecting portion may be configured to connect the set plate portion and the pump unit.

The filter member is not necessary to be arranged at the base portion, therefore, the base portion may be configured without the filter member. In this case, the filter member may be arranged at any other portion except the base portion. If the fuel to be sucked by the pump is maintained clean, the filter member does not have to be arranged to the fuel supply device.

The configuration for movably connecting the connecting portion relative to the pump unit is not restricted to inserting the connecting shaft provided to the pump unit into the connecting hole formed in the connecting portion. Alternatively, the configuration may also be by inserting the connecting shaft provided to the connecting portion into the connecting hole formed in the pump unit.

The protruding portion, which constitutes an element of the guide mechanism, may also be arranged on the connecting portion instead of the pump unit.

The protruding portion formed as the guide portion does not always have to be one single portion. Alternatively, a plurality of protruding portions, for example, in leftward and rightward directions, upward and downward directions, and forward and backward directions, may be provided. Further, a plurality of portions, for example recessed portions and through holes, which restrict the movable range of the protruding portion, may be provided. For example, the plurality of recessed portions and through holes may be arranged in the leftward and rightward directions, the upward and downward directions and/or the forward and backward directions.

The protruding portion, which configures an element of the guide mechanism, does not always have to be fitted into the recessed portion or the through hole. The movable range of the protruding portion may be free from the restriction of the other guide portion when the pump unit does not or does not substantially move relative to the connecting portion, while, for example, the fuel supply device is secured to the fuel tank. However, it is preferable that the movable range of the protruding portion is restricted by the other guide portion when the pump unit contacts the fuel tank and starts to move relative to the connecting portion. Alternatively, the guide mechanism may activate only since the pump unit starts to move relative to the connecting portion until reaches a predetermined distance. Even in this case, because the pump unit starts smoothly to move relative to the connecting portion, it moves smoothly even afterwards.

It is not necessary to configure the rotation restricting mechanism to restrict the rotational movement of the pump unit by abutting the pump unit to the connecting portion. For example, it is also possible to adopt a component, which applies force to prevent the pump unit from moving out of the predetermined area, to configure the rotation restricting mechanism.

Furthermore, it is not necessary to configure the connecting portion with the combination of the rod member and the joint portion. For example, it is not necessary to configure the connecting portion to be extendable and retractable, however, it may be configured so that relative positions of the cover member and the pump unit can be changed. As one example, it may be configured so that the relative positions of the cover member and the pump unit can be changed by configuring the connecting portion to be slidable relative to a rail provided on the cover member.

Moreover, as per the vehicle, the disclosure is not limited in scope to automobiles. It may also be used in a vehicle that flies in the air (e.g. an airplane or a helicopter), or that moves over the sea or in the sea (e.g. a ship or a submarine).

The invention claimed is:

1. A fuel supply device comprising:

a cover member attached to an opening of a fuel tank;

a pump unit provided with a pump;

a connecting portion configured to connect the cover member and the pump unit;

a connecting shaft which is formed on one of the connecting portion or the pump unit;

a connecting hole which is formed on the connecting portion if the connecting shaft is formed on the pump unit or formed on the pump unit if the connecting shaft is formed on the connecting portion, where the connecting shaft is configured to be inserted into the connecting hole so that the pump unit is relatively movably connected to the connecting portion; and a guide mechanism which is configured to guide the pump unit to move along a plane orthogonal to a longitudinal axis of the connecting shaft, wherein the guide mechanism includes a first guide portion formed at the connecting portion and a second guide portion formed at the pump unit, wherein one of the first guide portion or the second guide portion includes a protruding portion which protrudes in a position spaced apart from the connecting shaft, and a restricting portion is included in the first or second guide portion in which the protruding portion is not included and formed to restrict a movable range of said protruding portion.

2. The fuel supply device of claim 1, wherein the guide portion that restricts the protruding portion has a recessed portion in which the protruding portion is complementarily fitted to restrict the movable range of the protruding portion by fitting the protruding portion therein.

3. The fuel supply device of claim 1 further comprising: a rotation restricting mechanism configured to prevent a base portion, which is provided at the pump unit, from being positioned orthogonal to the plane in which the cover member extends by restricting a rotational angle of the pump unit relative to the connecting portion through the use of a stopping projection, which when the pump unit rotates towards the connecting portion, abuts the pump unit at an inclined angle relative to the cover member.

4. The fuel supply device of claim 3, wherein the rotation restricting mechanism is configured to restrict the rotational angle of the pump unit relative to the connecting portion that is at an incline of less than 90 degrees relative to the cover member, precluding orthogonality of the pump unit with respect to the cover member as the connecting portion abuts to the pump unit.

5. The fuel supply device of claim 1, wherein a point of rotation of the pump unit about the connecting shaft occurs at a location that is off-center relative to the pump unit such that a leading edge of the pump unit is distal from the point of rotation and a trailing edge of the pump unit is proximal to the point of rotation.

6. The fuel supply device of claim 1, wherein the restricting portion forms the first guide portion and the protruding portion forms the second guide portion, where the second guide portion protrudes in a plane perpendicular to the longitudinal axis of the connecting shaft.

7. The fuel supply device of claim 6, where the fit between the first guide portion and second guide portion is complementary, with the second guide portion forming an arc shape with a smaller width than the first guide portion, wherein the first guide portion has an inner peripheral surface forming a recess with a width larger than the second guide portion.

8. A fuel supply device comprising:

a cover member attached to an opening of a fuel tank;

a pump unit provided with a pump;

a connecting portion configured to connect the cover member and the pump unit;

a connecting shaft which is formed on one of the connecting portion or the pump unit;

a connecting hole which is formed on the connecting portion if the connecting shaft is formed on the pump unit or formed on the pump unit if the connecting shaft is formed on the connecting portion, wherein the connecting shaft is configured to be inserted into the connecting hole so that the pump unit is relatively movably connected to the connecting portion; and a rotation restricting mechanism comprising a stopper surface disposed on one of the connecting portion or the pump unit, wherein the stopper surface is configured to engage with a corresponding surface on the connecting portion if the stopper surface is disposed on the pump unit or on the pump unit if the stopper surface is disposed on the connecting portion to prevent a base portion, which is provided at the pump unit, from being positioned orthogonal to a set plate portion of the cover member by restricting a movable range of the pump unit relative to the connecting portion, wherein the set plate portion is coplanar with and parallel to the cover member.

9. A fuel supply device comprising:

a cover member attached to an opening of a fuel tank;

a pump unit provided with a pump;

a connecting portion configured to connect the cover member and the pump unit;

a connecting shaft which is formed on one of the connecting portion or the pump unit;

a connecting hole which is formed on the connecting portion if the connecting shaft is formed on the pump unit or formed on the pump unit if the connecting shaft is formed on the connecting portion, where the connecting shaft is configured to be inserted into the connecting hole so that the pump unit is relatively movably connected to the connecting portion;

a guide mechanism which is configured to guide the pump unit to move along a plane orthogonal to the longitudinal axis of the connecting shaft, wherein the guide mechanism includes a first guide portion formed on the connecting portion and a second guide portion formed on the pump unit, wherein one of the first guide portion or the second guide portion includes a protruding portion which protrudes in a position spaced apart from the connecting shaft, and a restricting portion is included in the first or second guide portion in which the protruding portion is not included and formed to restrict a movable range of said protruding portion; and a rotation restricting mechanism configured to prevent a base portion, which is provided at the pump unit, from being positioned orthogonal to a set plate portion of the cover member by restricting a movable range of the pump unit relative to the connecting portion, wherein the set plate portion is coplanar with and parallel to the cover member, wherein the rotation restricting mechanism is either provided by the first or second guide portions, or comprises an additional projection or flange formed on the first guide portion, the second guide portion, or independently of the first or second guide portion.

10. The fuel supply device of claim 9, wherein the rotation restriction mechanism is provided by the first or second guide portion, wherein the second guide portion comprises a columnar pin which is inserted into the first guide portion which comprises a through hole penetrating through one direction of the connecting portion.

11. The fuel supply device of claim 9, wherein the rotation restriction mechanism comprises a radially protruding flange which is contiguous with the shape of the second guide portion in a one-piece construction.

12. The fuel supply device of claim 9, wherein the rotation restriction mechanism comprises a radially protruding flange at the base of the pump unit independently of and spaced apart from the first and second guide portions.

* * * * *